United States Patent [19]

Ohta et al.

[11] Patent Number: 4,617,233

[45] Date of Patent: Oct. 14, 1986

[54] STRETCHED POLYETHYLENE FILAMENTS OF HIGH STRENGTH AND HIGH MODULUS, AND THEIR PRODUCTION

[75] Inventors: Toshihiko Ohta, Otsu; Fujio Okada, Shiga; Kiyokazu Okumoto, Otsu, all of Japan

[73] Assignee: Toyo Boseki Kabushiki Kaisha, Osaka, Japan

[21] Appl. No.: 612,240

[22] Filed: May 21, 1984

[30] Foreign Application Priority Data

May 20, 1983 [JP] Japan ..... 58-89654

[51] Int. Cl.[4] ..... D02G 3/00

[52] U.S. Cl. ..... 428/364; 264/210.7; 264/210.8; 428/902

[58] Field of Search ..... 428/364, 902; 526/348.1; 524/108, 366; 264/210.8, 210.7, 290.5

[56] References Cited

U.S. PATENT DOCUMENTS

| | | | |
|---|---|---|---|
| 3,944,536 | 3/1976 | Lupton et al. | 428/364 |
| 4,276,348 | 6/1981 | Wu et al. . | |
| 4,413,110 | 11/1983 | Kavesh et al. | 526/348.1 |
| 4,430,383 | 2/1984 | Smith et al. | 428/364 |

*Primary Examiner*—Lorraine T. Kendell

*Attorney, Agent, or Firm*—Jones, Tullar & Cooper

[57] ABSTRACT

Stretched filaments of high strength and high modulus being made of polyethylene of a weight average molecular weight of not less than $3 \times 10^6$ and having a strength of not less than 50 g/d and an initial modulus of not less than 1,500 g/d, the long period structure being substantially not observed, which are prepared by spinning a dilute solution of said polyethylene and stretching the resultant gel-like filaments in multi-stages until the long period structure becomes substantially not observed.

2 Claims, No Drawings

STRETCHED POLYETHYLENE FILAMENTS OF HIGH STRENGTH AND HIGH MODULUS, AND THEIR PRODUCTION

The present invention relates to stretched polyethylene filaments of high strength and high modulus, and their production.

In recent years, production of polyethylene filaments of high strength and high modulus by spinning a solution of polyethylene and stretching the resultant gel-like filaments was developed. For instance, Japanese Pat. Publication (unexamined) No. 15408/1981 (U.S. Pat. No. 4,422,993) discloses a process wherein a solution of polyethylene having a weight average molecular weight of more than $4\times10^5$ is spun and cooled, and the resulting gel-like filaments are stretched and dried to give polyethylene filaments. In this process, high strength (3.2 GPa (38 g/d)) and high modulus (92 GPa (1,083 g/d)) are achieved when the gel-like filaments are stretched at such a temperature as can provide a modulus of 20 GPa (235 g/d) or more, i.e. at a temperature of 135° C. at the highest. Higher strength (3.7 GPa (43 g/d)) as well as higher modulus (121 GPa (1409 g/d)) can be achieved by stretching the gel-like filaments in an air bath having a temperature gradient of 100° to 148° C. with a stretch ratio as high as possible. Further development of said process as disclosed in Japanese Pat. Publication (unexamined) No. 5228/1983 (U.S. Pat. No. 4,413,110) succeeded in providing polyethylene filaments having a strength of 45 g/d and a modulus of 2,305 g/d.

As a result of an extensive study, it has now been found that polyethylene filaments of high strength and high modulus, particularly having a remarkably high strength, can be obtained by spinning a dilute solution of polyethylene having a weight average molecular weight of not less than $3\times10^6$ and stretching the resultant gel-like filaments in multi stages until the long period structure becomes substantially not observed. This invention is based on the above finding.

According to the present invention, there is provided stretched filaments of high strength and high modulus, characterized in being made of polyethylene of a weight average molecular weight of not less than $3\times10^6$ and having a strength of not less than 50 g/d (particularly not less than 60 g/d) and an initial modulus of not less than 1,500 g/d (particularly not less than 2,000 g/d), the long period structure being substantially not observed.

The term "polyethylene" as hereinbefore and hereinafter used in the present specification is intended to mean a polymer of ethylene optionally with at least one other monomer copolymerizable therewith in an amount of not more than 20 mol % (particularly 10 mol %), which is optionally blended with any other polymer in an amount of not more than 20% by weight (particularly not more than 10% by weight). Particularly preferred is a homopolymer of ethylene. Examples of the other monomer copolymerizable with ethylene are propylene, butylene, chloroethylene, styrene, acrylic acid, methacrylic acid, methyl acrylate, ethyl acrylate, acrylonitrile, etc. Still, said polyethylene may be additionally incorporated with any conventional additive such as a light resistant agent or a stabilizer.

Characteristically, the polyethylene filaments of the invention have a strength of not less than 50 g/d, particularly of not less than 60 g/d, and an initial modulus of not less than 1,500 g/d, particularly of not less than 2,000 g/d. Although no upper limit is present on the strength and the initial modulus, they are usually and respectively not more than 70 g/d and not more than 2,600 g/d. The polyethylene filaments do not have the long period structure which can be definitely observed.

Said polyethylene filaments are obtainable by spinning a dilute solution of polyethylene and stretching the resultant gel-like filaments in multi-stages until the long period structure becomes substantially not observed.

The starting polyethylene has a weight average molecular weight of not less than $3\times10^6$. A higher molecular weight is better, because the gel-like filaments as intermediately produced can be stretched with a higher stretch ratio to give stretched filaments of higher strength and higher modulus. Thus, any upper limit is not present on the molecular weight, although it is usually not more than $1\times10^7$. When the molecular weight is less than said lower limit, stretching until the long period structure becomes substantially not observed is hardly possible. For facilitating the stretching until the long period structure becomes substantially not observed, the concentration of the polyethylene in the dilute solution is preferred to be not more than 3.0% by weight, preferably from 0.5 to 2.0% by weight.

As the solvent for preparation of the dilute solution, there may be used aliphatic hydrocarbons, alicyclic hydrocarbons, aromatic hydrocarbons, higher straight or branched chain hydrocarbons, etc., which preferably have a boiling temperature of not lower than 100° C. Specific examples are octene, nonane, decane, undecane, dodecane, toluene, xylene, naphthalene, tetralin, decalin, etc. Among them, the use of decalin is the most preferred.

The dilute solution may be prepared by adding polyethylene to said solvent so as to make a designed concentration of polyethylene and stirring the resultant mixture while heating so as to make a uniform solution.

For preparation of the gel-like filaments, the above obtained dilute solution may be subjected to spinning, for instance, by the use of a melt spinning machine or a dry spinning machine as conventionally employed. For example, the dilute solution under heating is extruded through spinning orifices by the aid of an extruder or a gear pump. Alternatively, the above obtained dilute solution may be cooled to room temperature to give a gel-like material, which is then redissolved in a dilute solution comprising the polyethylene in a concentration of not more than 3.0% by weight. This dilute solution may be subjected to spinning to obtain the gel-like filaments. Also, said gel-like material may be evaporated to make a dilute solution comprising the polyethylene in a 3.0% by weight concentration or less. This dilute solution may be subjected to spinning for obtainment of the gel-like filaments. The extruded filaments are cooled with a cooling gas or cooling liquid beneath the orifices to make gel-like filaments containing the solvent, which is then taken up on a take-up roll. In an alternative way, a hot gas may be applied to the gel-like filaments beneath the orifices to evaporate at least a part of the solvent contained therein and then taken up on a take-up roll. In another alternative way, the solvent contained in the gel-like filaments may be replaced by any other solvent and optionally evaporated to eliminate at least a part of the solvent, followed by taking up. Thus, the gel-like filaments may be either the one containing the solvent or the one not containing the solvent.

The gel-like filaments thus obtained are then stretched in multi stages until the long period structure becomes substantially not observed. Stretching is carried out usually in three or more stages, preferably in four or more stages. The temperature at stretching may be preferably so adjusted that a higher temperature is applied at a later stage. The overall draw ratio in the entire stages is normally not less than 60, preferably not less than 90. The draw ratio at the first stage or at each of the first and second stages is favored to be higher than that at the remaining stage(s). When, for instance, stretching is effected in four stages, the preferred conditions of stretching temperatures and stretch ratios may be as follows:

| | Stretching temperature | Stretch ratio |
|---|---|---|
| 1st stage | 50–90° C. (especially 70–90° C.) | not more than 10 (especially 4–6) |
| 2nd stage | 80–130° C. (especially 90–120° C.) | not more than 10 (especially 4–6) |
| 3rd stage | 110–140° C. (especially 120–135° C.) | not more than 5 (especially 1.5–3.0) |
| 4th stage | 135–155° C. (especially 135–150° C.) | not more than 5 (especially 1.5–2.0) |

Said multi stage stretching may be carried out subsequently and continuously to or separately and independently from the foregoing spinning step. Alternatively, stretching at the initial stage(s) may be carried out subsequently and continuously to the foregoing spinning step, while that at the final stage(s) may be effected separately and independently from said spinning step.

While stretching in the Examples as hereinafter presented is accomplished in four stages, numerous combinations of various conditions are possible for stretching. Accordingly, the extent of stretching as required may be determined on the long period structure. That is, the long period structure is observed according to the measuring procedure as set forth below, and stretching is effected until the long period structure becomes substantially not observed.

Measurement of long period structure of stretched filaments:

By the use of an X-ray diffraction apparatus "Rotarflex" manufactured by Rigaku Denki, the small angle X-ray scattering intensity curve is obtained under the conditions as set forth below, and the long period spacing is calculated from the locus of the peak therein.

Still, the long period spacing which can be measured under the conditions as indicated below is about 550 Å or less. When the long period spacing is more than about 550 Å, the locus of the peak becomes indefinite. The wording "the long period structure becomes substantially not observed" as used in the present specification is intended to mean that any definite peak is not observed in the small angle X-ray scattering intensity curve.

Conditions for measurement of the small angle X-ray scattering intensity curve

Detecting apparatus: PSPC (manufactured by Rigaku Denki)
Camera radius: 510 mm
PSPC separability: 0.007° /ch
Tube voltage of X-ray generating apparatus: 45 KV
Tube current of X-ray generating apparatus: 50 mA
First pinhole slit: 0.15 mm (diameter)
Second pinhole slit: 0.15 mm (diameter)
Size of beam stopper: 1.7 mm wide
Measuring time: 5 minutes.

The term "strength" used in the present specification is intended to mean the tensile strength as can be determined according to the measuring procedure for tensile strength described in JIS (Japanese Industrial Standard) L-1013 (1969). The term "initial modulus" is intended to mean the initial resistance to stretching which can be determined according to the measuring procedure for initial resistance to stretching described in JIS L-1013 (1969).

The stretched polyethylene filaments of high strength and high modulus according to this invention are made of polyethylene of a weight average molecular weight of not less than $3\times10^6$, having a strength of not less than 50 g/d and an initial modulus of not less than 1,500 g/d and do not have a long period structure as can be definitely observed. Such filaments are substantially constituted with crystalline structures and are entirely novel.

Practical and presently preferred embodiments of the invention are illustratively shown in the following examples, wherein part(s) and % are by weight unless otherwise indicated.

EXAMPLES 1 to 4

A spinning solution prepared by dissolving polyethylene in decalin was extruded through a spinneret having round orifices, each having a diameter of 0.8 mm, into water of 25° C. to make gel-like filaments. The gel-like filaments were taken up on a take-up roll and then subjected to stretching in four stages with a higher temperature at a later stage. The stretching was carried out in such a manner that the overall stretch ratio in the four stages became as large as possible.

The weight average molecular weight of polyethylene as used, the polyethylene content in the spinning solution (% by weight), the temperature of the spinning solution, the temperature for stretching in each stage, the stretch ratio in each stage, the overall stretch ratio and the strength and initial modulus of the stretched filaments are shown in Table 1.

None of the stretched filaments as shown in Table 1 showed a long period structure as could be definitely observed.

TABLE 1

| | Example | | | |
|---|---|---|---|---|
| | 1 | 2 | 3 | 4 |
| Average molecular weight | $4\times10^6$ | $4\times10^6$ | $3.5\times10^6$ | $3.5\times10^6$ |
| Polyethylene content in decalin (%) | 1.2 | 0.9 | 1.2 | 0.9 |
| Temperature of spinning solution (°C.) | 130 | 130 | 130 | 130 |
| Stretching temperature (°C.) | | | | |
| 1st stage | 80 | 70 | 80 | 70 |
| 2nd stage | 120 | 90 | 120 | 90 |
| 3rd stage | 135 | 120 | 135 | 120 |
| 4th stage | 148 | 148 | 148 | 148 |
| Stretch ratio | | | | |
| 1st stage | 5.0 | 5.0 | 5.0 | 5.0 |
| 2nd stage | 5.0 | 5.0 | 4.4 | 4.9 |
| 3rd stage | 2.6 | 2.4 | 2.4 | 2.1 |
| 4th stage | 2.0 | 1.8 | 1.8 | 2.0 |
| Overall stretch ratio | 130 | 108 | 95 | 103 |
| Tensile strength of stretched filaments (g/d) | 68 | 65 | 52 | 57 |
| Initial modulus of stretched filaments (g/d) | 2,500 | 2,100 | 1,700 | 1,900 |
| Long period spacing | Not | Not | Not | Not |

TABLE 1-continued

| | Example | | | |
|---|---|---|---|---|
| | 1 | 2 | 3 | 4 |
| of stretched filaments | observed | observed | observed | observed |

COMPARATIVE EXAMPLE 1

Polyethylene (weight average molecular weight, $1.5\times10^6$) was dissolved in decalin to make a spinning solution having a polyethylene content of 2.0%, and the spinning solution of 130° C. was extruded into the air of 21° C. through a spinneret having orifices, each orifice having a diameter of 0.5 mm, to make gel-like filaments, which were taken up on a take-up roll. The gel-like filaments were subjected to stretching at 120° C. with a maximum draw ratio of 30. The stretched filaments had a strength of 35 g/d and an initial modulus of 1,020 g/d. The long period spacing was about 470 Å.

COMPARATIVE EXAMPLE 2

Polyethylene (weight average molecular weight, $2.5\times10^6$) was dissolved in liquid paraffin to make a spinning solution having a polyethylene content of 6.0%, and the spinning solution of 200° C. was extruded into the air of 21° C. through a spinneret having orifices, each orifice having a diameter of 0.5 mm, and led into water at a distance of 33 cm from the spinneret to make gel-like filaments, followed by taking up with a take-up roll. The gel-like filaments were dipped into trichlorotrifluoroethane so as to replace liquid paraffin in the gel-like filaments thereby and dried. The dried filaments were subjected to stretching through a stretching tank of 100° C. at the entrance and 140° C. at the discharge exit with a stretch ratio of 75. The stretched filaments had a strength of 42 g/d and an initial modulus of 1,510 g/d. The long period spacing was about 490 Å.

What is claimed is:

1. Stretched polyethylene filaments of high strength and high modulus, characterized by being made of polyethylene of a weight average molecular weight of not less than $3\times10^6$, a strength of not less than 50 g/d, an initial modulus of not less than 1,500 g/d, and no observable long period spacing.

2. The filaments according to claim 1, wherein the strength is not less than 60 g/d and the initial modulus is not less than 2,000 g/a.

* * * * *